US009613610B2

(12) United States Patent
Park et al.

(10) Patent No.: US 9,613,610 B2
(45) Date of Patent: Apr. 4, 2017

(54) DIRECTIONAL SOUND MASKING

(71) Applicant: KONINKLIJKE PHILIPS N.V., Eindhoven (NL)

(72) Inventors: Mun Hum Park, Eindhoven (NL); Armin Gerhard Kohlrausch, Eindhoven (NL); Arno Van Leest, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 82 days.

(21) Appl. No.: 14/414,528

(22) PCT Filed: Jul. 12, 2013

(86) PCT No.: PCT/IB2013/055726

§ 371 (c)(1),
(2) Date: Jan. 13, 2015

(87) PCT Pub. No.: WO2014/016723

PCT Pub. Date: Jan. 30, 2014

(65) Prior Publication Data

US 2015/0194144 A1 Jul. 9, 2015

Related U.S. Application Data

(60) Provisional application No. 61/674,920, filed on Jul. 24, 2012.

(51) Int. Cl.
*G10K 11/175* (2006.01)
*H04K 3/00* (2006.01)

(52) U.S. Cl.
CPC ..... *G10K 11/175* (2013.01); *H04K 3/41* (2013.01); *H04K 3/42* (2013.01); *H04K 3/43* (2013.01);

(Continued)

(58) Field of Classification Search
CPC ..... G10K 11/175; G10K 2210/111; G10K 2210/3028; H04K 3/825; H04K 3/42;

(Continued)

(56) References Cited

U.S. PATENT DOCUMENTS

2009/0074199 A1* 3/2009 Kierstein ..... G10K 11/175 381/71.6
2012/0316869 A1* 12/2012 Xiang ..... H04K 1/02 704/226

(Continued)

FOREIGN PATENT DOCUMENTS

JP 2005258158 A 9/2005
KR 20080041738 A 5/2008

(Continued)

OTHER PUBLICATIONS

Stanchina, M.L. et al. (2005), "The influence of white noise on sleep in subjects exposed to ICU noise", Sleep Medicine 6(5):423-428.

(Continued)

*Primary Examiner* — David Ton

(57) ABSTRACT

The invention relates to a system for masking a sound incident on a person. The system comprises a microphone sub-system for capturing the sound. The system further comprises a spectrum-analyzer for determining a power attribute of the sound captured by the multiple microphone sub-system, and a spatial analyzer for determining a directional attribute of the captured sound representative of a direction of incidence on the person. The system further comprises a generator sub-system for generating a masking sound under combined control of the power attribute and the spatial attribute, for masking the incident sound.

10 Claims, 3 Drawing Sheets

(52) U.S. Cl.
CPC ..... *H04K 3/45* (2013.01); *H04K 3/825* (2013.01); *G10K 2210/111* (2013.01); *G10K 2210/3028* (2013.01); *H04K 2203/12* (2013.01); *H04K 2203/32* (2013.01); *H04K 2203/34* (2013.01)

(58) Field of Classification Search
CPC .. H04K 3/43; H04K 3/45; H04K 3/41; H04K 2203/12; H04K 2203/34; H04K 2203/32
USPC ..... 381/73.1, 74, 317, 71.1, 71.6
See application file for complete search history.

(56) References Cited

U.S. PATENT DOCUMENTS

| | | | |
|---|---|---|---|
| 2013/0170655 | A1 | 7/2013 | Satoyoshi et al. |
| 2013/0170662 | A1 | 7/2013 | Koga et al. |

FOREIGN PATENT DOCUMENTS

| | | | |
|---|---|---|---|
| KR | 20090116055 | A | 5/2008 |
| WO | 2011043678 | A | 4/2011 |
| WO | 2012043596 | A1 | 4/2012 |
| WO | 2012043597 | A1 | 4/2012 |
| WO | 2012170128 | A1 | 12/2012 |

OTHER PUBLICATIONS

Blauert, J., "Spatialhearing: The Psychophysics of human sound localization", Cambridge, MA; MIT Press, 2001, chapter 3.2.2.

Cherry, E. C. (1953), "Some experiments on the recognition of speech, with one and with two ears", Journal of the Acoustical Society of America 25 (5): 975-979.

Van Veen, B.D. et al. "Beamforming: a versatile approach to spatial filtering", IEEE ASSP Magazine, Apr. 1988, pp. 4-24.

Park, M.J. et al. "Evaluation of a speech masking algorithm for improved cognitive performance", Technical note PR-TN-2010/00311.

Moore, B. (2003). "An introduction to the psychology of hearing." Academic Press, London.

* cited by examiner

DIRECTIONAL SOUND MASKING

CROSS-REFERENCE TO PRIOR APPLICATIONS

This application is the U.S. National Phase application under 35 U.S.C. §371 of International Application No. PCT/IB2013/055726, filed on Jul. 12, 2013, which claims the benefit of U.S. Provisional Application No. 61/674,920, filed on Jul. 24, 2012. This application is hereby incorporated by reference herein.

FIELD OF THE INVENTION

The invention relates to a system configured for masking sound incident on a person. The invention also relates to a signal-processing sub-system for use in a system of the invention, to a method of masking sound incident on a person, and to control software for configuring a computer to carry out a method of the invention.

BACKGROUND ART

Sound masking is the addition of natural or artificial sound (such as white noise) into an environment to cover up unwanted sound. This is in contrast to the technique of active noise control. Sound masking reduces or eliminates awareness of pre-existing sounds in a given environment and can make the environment more comfortable. For example, devices are commercially available for being installed in a room in order to mask sounds that otherwise might interfere with a person's working or sleeping in the room.

It is known in the art that not the peak sound-level, but rather the peak-to-baseline sound-level is related to the number of awakenings caused by the sounds to the patient's sleep. By adding a masking sound, therefore, the threshold for being awakened from sleep is raised, resulting in a more comfortable sleep environment. See, e.g., Stanchina, M., Abu-Hijleh, M., Chaudhry, B. K., Carlisle, C. C., Millman, R. P. (2005), *"The influence of white noise on sleep in subjects exposed to ICU noise"*, Sleep Medicine 6(5): 423-428, for a discussion of the relationship between peak-to-baseline sound-level and threshold within the context of experiments conducted at an intensive-care unit of a hospital.

Sound masking devices are commercially available that produce stationary acoustic noise in a relatively wide frequency band to reduce the chance that a user will get awakened during his/her sleep as a result of ambient sounds. In some of these devices, a microphone is used to capture the potentially disturbing sound for subjecting the potentially disturbing sound to an analysis in order to adjust the masking sound to the level of the intensity of the disturbing sound and to the spectral characteristics of the disturbing sound.

The commercially available sound masking devices typically use a single loudspeaker to reproduce a sound in a relatively wide frequency-band, e.g., white noise. Some of the commercially available products come with a headphone connection, so that the masking sound does not disturb nearby persons in operational use of the product. However, the sound reproduced over the headphones is often only a duplication of the single channel.

SUMMARY OF THE INVENTION

The inventors have realized that the commercially available sound masking systems do not take directionality of the undesired sounds into account.

As to directionality of sounds, reference is made to Jens Blauert, *"Spatial Hearing: The Psychophysics of Human Sound Localization"*, Cambridge, Mass.; MIT Press, 2001, especially to chapter 3.2.2. Blauert discusses a scenario wherein a group of people is present within the same room and wherein several conversations are going on at the same time. A listener is able to focus his/her auditory attention on one particular speaker amidst the din of voices, even without facing this particular speaker. However, if the listener plugs one of his/her ears, the listener will have much more difficulties with understanding what this particular speaker is saying. This psychoacoustic phenomenon is known in the art as the "cocktail party effect" or as "selective attention". For more background information on the "cocktail party effect", see, e.g., Cherry, E. Colin (1953), *"Some Experiments on the Recognition of Speech, with One and with Two Ears"*, Journal of the Acoustical Society of America 25 (5): 975-979. This phenomenon arises from the fact that a person, who is listening to a desired auditory signal with a certain direction of incidence in an environment with noise from another direction of incidence, can identify the desired auditory signal better when he/she is listening binaurally (i.e., with two ears) than when he/she is listening monaurally (i.e., with one ear only). In other words, a person can better identify a desired auditory signal in the presence of auditory noise, if the person is listening binaurally rather than monaurally, and if the desired auditory signal and the auditory noise have different directions of incidence.

The inventors now have turned this around and propose a deliberate sound masking scenario wherein an undesired sound is masked by an artificially generated noise that is controlled so as to have substantially the same direction of incidence on a person who is to be acoustically disturbed as little as possible.

More specifically, the inventors propose a system configured for masking a sound incident on a person. The system comprises a microphone sub-system for capturing the sound at multiple locations simultaneously; a loudspeaker sub-system for generating a masking sound under control of the captured sound; and a signal-processing sub-system coupled between the microphone sub-system and the loudspeaker sub-system. The signal-processing sub-system is configured for: determining a power attribute of a frequency spectrum of the captured sound that is representative of a power in a frequency band of the captured sound; determining a directional attribute of the captured sound in the frequency band that is representative of a direction from which the sound is incident on the person; and controlling the loudspeaker sub-system to generate the masking sound under combined control of the power attribute and the spatial attribute.

In the system of the invention, the power attribute of the captured incident sound is determined so as to control a spectrum of the masking sound, and the directional attribute is determined in order to generate the masking sound that, when perceived by the person, appears to be coming from a direction similar to the direction of incidence of the incident sound so as to make the masking more efficient.

As known, the human ear processes sounds in parallel in the sense that the ear processes different spectral components simultaneously. The cochlea of the inner ear appears to act as a spectrum analyzer for performing a frequency analysis of the incoming sound and is often modeled in psychoacoustics as a bank of stagger-tuned, overlapping auditory band-pass filters. However, the cochlea is a dynamic system wherein the characteristic parameters of each band-pass filter, e.g., the filter's center frequency (at its peak), bandwidth and gain, are capable of being modified under unconscious control. Measurements made of the filtering properties of the cochlea indicate that the shape of each band-pass filter is asymmetric with a steeper slope on the high-frequency side and a slower decaying tail extending on the low-frequency side. In psychoacoustic modeling, the asymmetric filter shape per individual auditory band-pass filter is typically replaced, for practical reasons, by a symmetric frequency-response function, known as the Rounded-Exponential (RoEx) shape, and the effective filter bandwidth is expressed as the Equivalent Rectangular Bandwidth (ERB).

In the system in the invention, the power attribute as determined, comprises a respective indication representative of a respective frequency spectrum in a respective one of a plurality of frequency bands. Accordingly, the embodiment of the system can mask in parallel different incident sounds emitted at the same time by different sources at different locations and having different frequency spectra.

In an embodiment of the system in the invention, the microphone sub-system supplies a first signal representative of the sound captured. The signal-processing sub-system supplies a second signal for control of the loudspeaker sub-system. The system comprises an adaptive filtering sub-system operative to reduce a contribution from the masking sound, present in the captured sound, to the second signal. The adaptive filtering system comprises an adaptive filter and a subtractor. The adaptive filter has a filter input for receiving the second signal and a filter output for supplying a filtered version of the second signal. The subtractor has a first subtractor input for receiving the first signal, a second subtractor input for receiving the filtered version of the second signal, and a subtractor output for supplying a third signal to the signal-processing sub-system that is representative of a difference between the first signal and the filtered version of the second signal. The adaptive filter has a control input for receiving the third signal for control of one or more filter coefficients of the adaptive filter.

In a configuration, wherein the microphone sub-system is not sufficiently well acoustically isolated from the loudspeaker sub-system, the sound captured by the microphone sub-system comprise the sound to be masked as well as the masking sound. The adaptive filtering sees to it that the masking sound as captured is substantially prevented from affecting the generation of the masking sound itself.

In a further embodiment of a system in the invention, the signal-processing sub-system comprises a spatial analyzer for determining the directional attribute, and wherein the spatial analyzer is operative to determine the directional attribute based on at least one of: determining a quantity representative of at least one of an interaural time difference (ITD) and an interaural level difference (ILD); and using abeamforming technique.

In human sound localization, the concepts "interaural time difference" (ITD) and "interaural level difference" (ILD) refer to physical quantities that enable a person to determine a lateral direction (left, right) from which a sound appears to be coming.

As known, beamforming is a signal-processing technique used in sensor arrays for directional signal transmission or reception. This is achieved by combining elements in the array in such a way that signals at particular angles experience constructive interference while others experience destructive interference. Beamforming can be used at both the transmitting and receiving ends in order to achieve spatial selectivity. For more background see, e.g., "Beamforming: A versatile approach to spatial filtering", B. D. V. Veen and K. M. Buckley, IEEE ASSP Magazine, April 1988, pp. 4-24.

A further embodiment of the system of the invention comprises a sound classifier that is operative to selectively remove a pre-determined portion from the captured sound before carrying out the determining of the power attribute and before carrying out the determining of the spatial attribute.

The sound classifier is configured to discriminate between sounds, captured by the microphone sub-system and which are to be masked, and other sounds, which are captured by the microphone sub-system and which are not to be masked (e.g., a human voice or an alarm), so as to selectively subject captured sounds to the process of being masked. The classifier may be implemented by, e.g., analyzing the spectrum of the captured sound and identifying one or more patterns therein that match pre-determined criteria.

The invention further relates to a signal-processing sub-system for use in the system as specified above.

The invention can be commercially exploited by making, using or providing a system of the invention as specified above. Alternatively, the invention can be commercially exploited by making, using or providing a signal-processing sub-system configured for use in a system of the invention. At the location of intended use, the signal-processing sub-system is then coupled to a microphone-sub-system, a loudspeaker sub-system, and, possibly to an adaptive filter and/or to a classifier obtained from other suppliers.

The invention can also be commercially exploited by carrying out a method according to the invention. The invention therefore also relates to a method for masking a sound incident on a person. The method comprises: capturing the sound at multiple locations simultaneously; determining a power attribute of a frequency spectrum of the captured sound that is representative of a power in a frequency band of the captured sound; determining a directional attribute of the captured sound in the frequency band that is representative of a direction from which the sound is incident on the person; and generating a masking sound under combined control of the power attribute and the spatial attribute.

In an embodiment of a method of the invention, the method comprises: receiving a first signal representative of the sound captured; supplying a second signal for generating the masking sound; and adaptive filtering for reducing a contribution from the masking sound, present in the captured sound, to the second signal. The adaptive filtering comprises: receiving the second signal; using an adaptive filter for supplying a filtered version of the second signal;

supplying a third signal that is representative of a difference between the first signal and the filtered version of the second signal; receiving the third signal for control of one or more filter coefficients of the adaptive filter; and using the third signal for the determining of the power attribute and for the determining of the directional attribute.

In a further embodiment of a method of the invention, the determining of the directional attribute comprises at least one of: determining a quantity representative of at least one of an interaural time difference (ITD) and an interaural level difference (ILD); and using a beamforming technique.

A further embodiment of a method according to the invention comprises selectively removing a pre-determined portion from the captured sound before carrying out the determining of the power attribute and before carrying out the determining of the spatial attribute.

The invention can also be commercially exploited as control software, either supplied as stored on a computer-readable medium such as, e.g., a solid-state memory, an optical disk, a magnetic disc, etc., or made available as an electronic file downloadable via a data network, e.g., the Internet.

The invention therefore also relates to control software for being run on a computer for configuring the computer to carry out a method of masking a sound incident on a person, wherein the control software comprises: first instructions for receiving a first signal representative of the sound captured at multiple locations simultaneously; second instructions for determining a power attribute of a frequency spectrum of the captured sound that is representative of a power in a frequency band of the captured sound; third instructions for determining a directional attribute of the captured sound in the frequency band that is representative of a direction from which the sound is incident on the person; and fourth instructions for generating a second signal for generating a masking sound under combined control of the power attribute and the spatial attribute.

In an embodiment of the control software of the invention, the control software comprises fifth instructions for adaptive filtering for reducing a contribution from the masking sound, present in the captured sound, to the second signal. The fifth instructions comprise: sixth instructions for receiving the second signal; seventh instructions for using an adaptive filter for supplying a filtered version of the second signal; eighth instructions for supplying a third signal that is representative of a difference between the first signal and the filtered version of the second signal; and ninth instructions for receiving the third signal for control of one or more filter coefficients of the adaptive filter. The second instructions comprise tenth instruction for using the third signal for the determining of the power attribute. The third instructions comprise eleventh instructions for using the third signal for the determining of the directional attribute.

In a further embodiment of the control software of the invention, the third instructions comprise at least one of: twelfth instructions for determining a quantity representative of at least one of an interaural time difference and an interaural level difference; and thirteenth instructions for carrying out a beamforming technique.

A further embodiment of the control software of the invention, comprises fourteenth instructions for selectively removing a pre-determined portion from the captured sound before carrying out the determining of the power attribute and before carrying out the determining of the spatial attribute.

For completeness, reference is made to International Application Publication WO2011043678, titled "TINNITUS TREATMENT SYSTEM AND METHOD". As known, tinnitus is a person's perception of a sound inside the person's head in the absence of auditory stimulation. International Application Publication WO2011043678 relates to a tinnitus masking system for use by a person having tinnitus. The system comprises a sound delivery system having left and right ear-level audio delivery devices and is configured to deliver a masking sound to the person via the audio delivery devices such that the masking sound appears to originate from a virtual sound source location that substantially corresponds to the spatial location in 3D auditory space of the source of the tinnitus as perceived by the person.

The known system and method are based on masking the tinnitus and/or desensitizing the patient to the tinnitus. It has been identified that some of the distress associated with tinnitus is related to a violation of tinnitus perception from normal Auditory Scene Analysis (ASA). In particular, it has been identified that neural activity forming tinnitus is sufficiently different from normal sound activity that when formed into a whole image it conflicts with memory of true sounds. In other words, tinnitus does not localize to an external source. An inability to localize a sound source is "unnatural" and a violation of the fundamental perceptual process. Additionally, it has been identified that it is a lack of a context, or a lack of behaviorally relevant meaning, that force the brain too repeatedly or strongly attend to the tinnitus signal. For example, the sound of rain in the background is easily habituated to. The sound is associated with a visual and tactile perception or perceptual memory of rain as well. The context of the sound is understood so it can be processed and dismissed as unworthy of further attention. However, there is no such understanding of the tinnitus signal, which does not correspond to a true auditory object. The known tinnitus treatment and system employs customized informational masking and desensitization. Informational masking acts at a level of cognition and limits the brains capacity to process tinnitus. Tinnitus masking is enhanced by spatially overlapping the perceived tinnitus location and the spatial representation (or the virtual sound source location) of the masking sound.

In contrast, the invention relates to masking actual sound from one or more actual sources and is not concerned with informational masking at a level of cognition to limit the brains capacity to process tinnitus.

BRIEF DESCRIPTION OF THE DRAWING

The invention is explained in further detail, by way of example and with reference to the accompanying drawing, wherein.

Throughout the Figures, similar or corresponding features are indicated by same reference numerals.

DETAILED EMBODIMENTS

The invention relates to a system and method for masking a sound incident on a person. The system comprises a microphone sub-system for capturing the sound. The system further comprises a spectrum-analyzer for determining a power attribute of the sound captured by the multiple microphone sub-system, and a spatial analyzer for determining a directional attribute of the captured sound representative of a direction of incidence on the person. The system further comprises a generator sub-system for generating a masking sound under combined control of the power attribute and the spatial attribute, for masking the incident sound.

Figure 1:
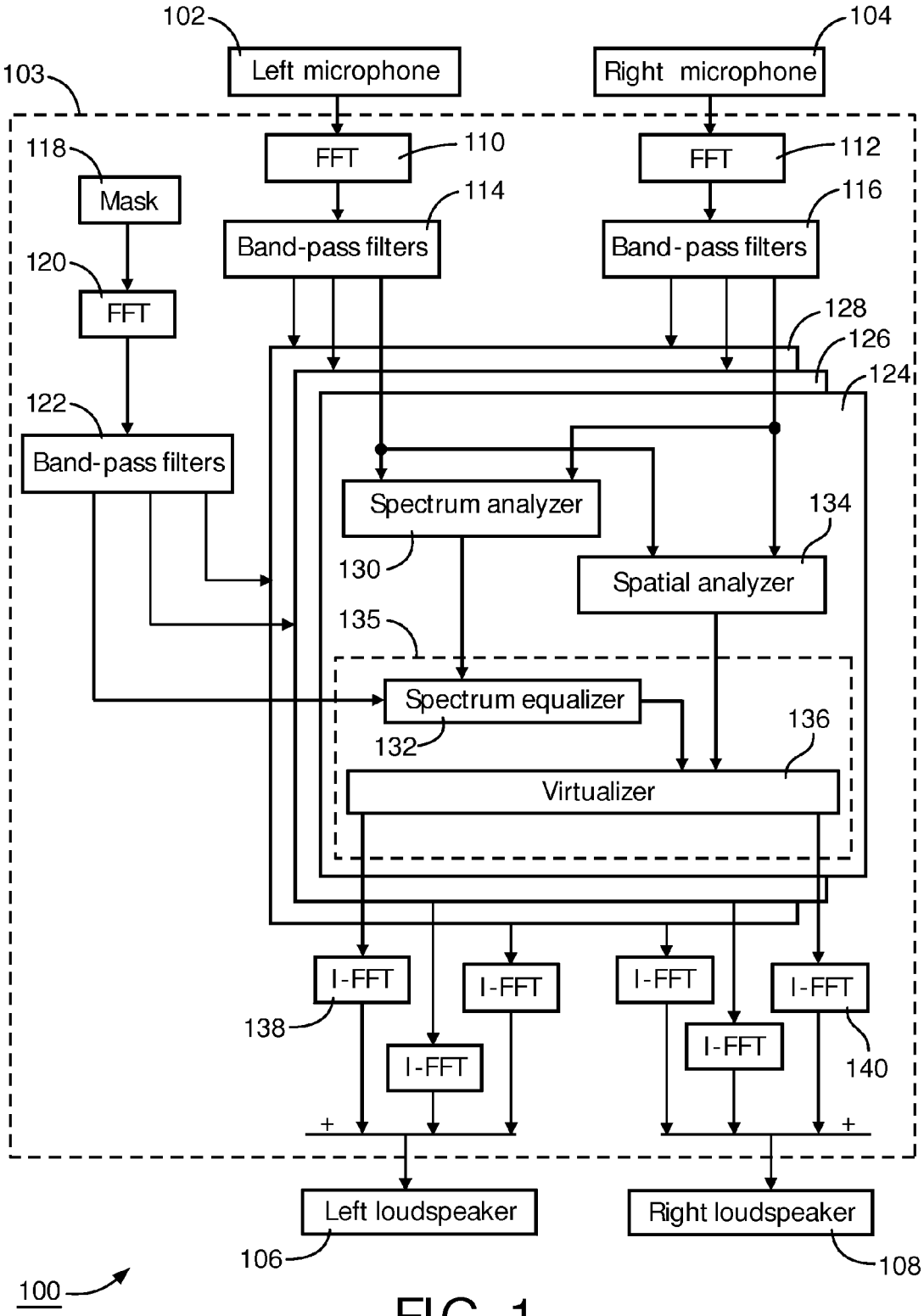
FIG. 1 is a block diagram of a first embodiment of a system in the invention.

FIG. 1 is a diagram of a first embodiment 100 of a system in the invention. The first embodiment 100 comprises a left microphone 102 placed at, or near, the user's left ear (not shown) and a right microphone 104 placed at, or near, the user's right ear (not shown). The first embodiment 100 comprises a left loudspeaker 106, placed at, or in, the user's left ear, and a right loudspeaker 108 placed at, or in, the user's right ear. It is assumed in the first embodiment 100 that each of the left microphone 102 and the right microphone 104 is acoustically well isolated from both the left loudspeaker 106 and the right loudspeaker 108. For example, the left microphone 102, the right microphone 104, the left loudspeaker 106 and the right loudspeaker 108 form part of a pair of microphone-equipped earphones, such as the Roland CS-10EM, which is commercially available. The left loudspeaker 106 fits into the left ear, and the right loudspeaker 108 fits into the right ear, whereas the left microphone 102 and the right microphone 104 each face outwards relative to the head of the user. As the left microphone 102 and the right microphone 104 are configured, for all practical purposes, to not pick up the sounds emitted by the left loudspeaker 106 and the right loudspeaker 108, the left microphone 102 and the right microphone 104 are said to be acoustically well isolated from the left loudspeaker 106 and the right loudspeaker 108.

The first embodiment 100 comprises a signal-processing sub-system 103 between, on the one hand, the left microphone 102 and the right microphone 104 and, on the other hand, the left loudspeaker 106 and the right loudspeaker 108. The functionality of the signal-processing sub-system 103 will now be discussed.

The left microphone 102 captures sounds incident on the left microphone 102 and produces a left audio signal for a left audio channel. The left audio signal is converted to the frequency domain in a left converter 110 that produces a left spectrum. Likewise, the right microphone 104 captures sounds incident on the right microphone 104 and produces a right audio signal for a right audio channel. The right audio signal is converted to the frequency domain by a right converter 112 that produces a right spectrum. Operation of the left converter 110 and of the right converter 112 is based on, e.g., the Fast-Fourier Transform (FFT).

The left spectrum is supplied to a set of one or more left band-pass filters 114 that determines one or more frequency bands in the left spectrum. Likewise, the right spectrum is supplied to a set of one or more right band-pass filters 116 that determines one or more frequency bands in the right spectrum. Dividing each respective one of the left spectrum and the right spectrum into respective frequency bands enables to separately process different bands in the same spectrum. For example, the set of left band-pass filters 114 determines one or more frequency bands in the left spectrum, wherein each particular one of the frequency bands is associated with a particular one of the auditory band-pass filters. As mentioned above, the asymmetric filter shape per individual band-pass filter in a psychoacoustic model of auditory perception is approximated in practice by a symmetric frequency-response function, known as the Rounded Exponential (RoEx) shape. Similarly, the set of right band-pass filters 116 determines one or more frequency bands in the right spectrum, wherein each particular one of the frequency bands is associated with a particular one of the auditory band-pass filters.

The first embodiment 100 also comprises a masking sound generator 118 that is configured for generating a signal representative of the masking sound. The masking sound signal is converted to the frequency domain by a further frequency converter 120 to generate a spectrum of the masking sound. The spectrum of the masking sound is supplied to a set of one or more further band-pass filters 122. The set of further band-pass filters 122 determines respective frequency bands in the spectrum of the masking sound that correspond with respective ones of the frequency ranges determined by the set of left band-pass filters 114 and the set of right band-pass filters 116.

A particular part of the left spectrum associated with a particular frequency range, another particular part of the right spectrum associated with this particular frequency range and a further particular part of the spectrum of the masking sound associated with the particular frequency range are supplied to a particular one of a first sub-system 124, a second sub-system 126, a third sub-system 128, etc. In the following, the processing of the particular part of the left spectrum, of the other particular part of the right spectrum and of the further particular part of the spectrum of the masking sound is explained with reference to the processing by the first sub-system 124.

The first sub-system 124 comprises a spectrum analyzer 130, a spatial analyzer 134 and a generator sub-system 135. The generator sub-system 135 comprises a spectrum equalizer 132 and a virtualizer 136. The second sub-system 126, the third sub-system 128, etc., have a configuration similar to that of the first sub-system 124. The generator sub-system 135 is configured to generate a masking sound under combined control of a power attribute, as determined by the spectrum analyzer 130, and a spatial attribute as determined by the spatial analyzer 134, for masking the sound as captured by the left microphone 102 and the right microphone 104.

The spectrum analyzer 130 is configured for estimating, or determining, the power in the relevant one of the frequency ranges that is being handled by the first sub-system 124 for the sound captured by the left microphone 102 and the right microphone combined.

The power in the relevant frequency range as determined by the spectrum analyzer, suitably averaged over time, is used to control the spectrum equalizer 132. The spectrum equalizer 132 is configured to adjust the power in the relevant frequency range of the masking sound under control of the power estimated by the spectrum analyzer 130 as being present in the relevant frequency range of the incident sound captured by the left microphone 102 and the right microphone 104. Optionally, the spectrum equalizer 132 is adjustable so as to set control parameters in advance for adjusting the power in the relevant frequency range of the masking sound in dependence on the power spectrum of the relevant frequency range of the captured sound. For example, the adjustability of the spectrum equalizer enables to limit a ratio between the power in the frequency range of the captured sound and the power in the frequency range of the masking sound to a range between a minimum value and a maximum value. This limiting of the ratio assists in creating a masking sound that will be perceived by the user as more natural rather than artificial.

The spatial analyzer 134 is configured to determine a spatial attribute, e.g., a direction of incidence on the left microphone 102 and on the right microphone 104, of that particular contribution of the sound, which is captured by the left microphone 102 and the right microphone 104 and which is associated with the relevant frequency range.

The spatial analyzer 134 thus performs sound localization of the contribution to the captured sound in the relevant frequency range. The expression "sound localization" as used in the art refers to a person's ability to identify a location of a detected sound in direction and distance. Sound localization may also refer to methods in acoustical engineering to simulate the placement of an auditory cue in a virtual three-dimensional space. In human sound localization, the concepts "interaural time difference" (LTD) and "interaural level differencne" (ILD) refer to physical quantities that enable a person to determine a lateral direction (left, right) from which a sound appears to be coming. The ITD is the difference in arrival times of a sound arriving at the person's left ear and the person's right ear. If a sound signal arrives at the person's head from one side, the sound signal has to travel farther to reach the far ear than the near ear. This difference in path length results in a time difference between the sound's arrivals at the ears, which is detected and aids the process of identifying the direction from which the sound appears to be coming. As to the ILD, sound arriving at the person's near ear has a higher energy level than the sound arriving at the person's far ear, as the far ear is located in the acoustic shadow of the person's head which causes a significant attenuation of the sound signal. The ILD is noticeably frequency-dependent as the characteristic dimension of a person's head is within a range of wavelength in the audible spectrum. The spatial analyzer 134 is configured, e.g., to determine a quantity representative of at least one of the ITD and ILD for the sound captured by the left microphone 102 and the right microphone 104.

The virtualizer 136 is configured for generating, under combined control of the spectrum equalizer 130 and the spatial analyzer 134, a left-channel representation and a right-channel representation of a masking sound in the frequency domain and associated with the relevant frequency range. The left-channel representation is supplied to a left inverse-converter 138 for being converted to the time-domain, e.g., through an inverse FFT. The left-channel representation in the time-domain is then supplied to the left loudspeaker 106. Similarly, the right-channel representation is supplied to a right inverse-converter 140 for being converted to the time-domain, e.g., through an inverse FFT. The right-channel representation in the time-domain is then supplied to the right loudspeaker 108.

Each respective one of the second sub-system 126 and the third sub-system 128, etc., performs similar operations for processing a respective contribution to the captured sound from a respective other frequency range. The eventual masking sound as played out at the left loudspeaker 106 and the right loudspeaker 108 then comprises the respective left-channel representation in the time domain and the respective right-channel representation in the time domain as supplied by a respective one of the first sub-system 124, the second sub-system 126, the third sub-system 128 etc.

For completeness, it is remarked here that more than two microphones and more than two loudspeakers can be exploited so as to be able to determine directionality of the incident sound with higher resolution and so as to be able to play out a masking sound with a higher directional resolution. Note also that the sound, captured by the microphones, here: the left microphone 102 and the right microphone 104, may stem from two or more sources or may be incident on the microphones from multiple directions (e.g., through multiple reflections at acoustically reflecting objects within range of the microphones). The first embodiment 100 determines the power spectrum and direction of incidence per individual one of the frequency ranges and generates an eventual masking sound taking into account the multiple sources and/or multiple directions of incidence.

Also, in the case of generating a binaural masking sound, some reverberation may be added so as to strengthen the impression by the user that the masking sound as perceived stems from one or more sources external to the user's head.

For completeness, it is remarked here that the first embodiment 100 is illustrated as including the left microphone 102 and the right microphone 104. If one or more additional microphones are present in the first embodiment 100, the output signal of each additional microphone is supplied to an additional frequency converter (not shown), and from there to an additional set of band-pass filters (not shown). Each individual one of the band-pass filters of the additional set supplies a particular output signal, indicative of a particular frequency range, to a particular one of the first sub-system 124, the second sub-system 126, the third sub-system 128, etc. Consider the specific output signal of the additional set of band-pass filters that is supplied to the first sub-system 124. The specific output signal is then supplied to the spectrum analyzer 130 and to the spatial analyzer 134, in parallel to the left output signal of the set of left band-pass filters 114 supplied to the first sub-system 124, and in parallel to the right output signal of the set of right band-pass filters 116 as supplied to the first sub-system 124.

Consider now a scenario, wherein one or both of the left microphone 102 and the right microphone 104 is not acoustically well isolated from the left loudspeaker 106 and/or from the right loudspeaker 108. For example, a typical active noise-cancellation headphone has both a loudspeaker unit and a microphone unit positioned inside each of the ear cups. That is, a typical active noise-cancellation headphone has the left microphone 102 and the left loudspeaker 106 positioned inside the left ear cup, and has the right microphone 104 and the right loudspeaker 108 positioned inside the right ear cup. As a result, the masking sound reproduced by the left loudspeaker 106 will be picked up by the left microphone 102, and the masking sound reproduced by the right loudspeaker 108 will be picked up by the right microphone 104. In this case, it is necessary to remove the masking sound reproduced by the left loudspeaker 106 from the sound that is captured by the left microphone 102, and to remove the masking sound reproduced by the right loudspeaker 108 from the sound captured by the right microphone 104, so as to subject the thus modified captured sound to the signal processing carried out by the signal-processing sub-system 103.

Likewise, consider another scenario, wherein the left microphone 102, the right microphone 104, the left loudspeaker 106 and the right loudspeaker 108 are positioned away from the user's ears. As a result, each individual one of the left microphone 102 and the right microphone 104 is acoustically coupled to both the left loudspeaker 106 and the right loudspeaker 108. In this case, it is necessary as well to remove the masking sound reproduced by the left loudspeaker 106 and the masking sound produced by the right loudspeaker 108 from the sound that is captured by each individual one of the left microphone 102 and the right microphone 104, so as to subject the thus modified captured sound to the signal processing carried out by the signal-processing sub-system 103 as discussed above with reference to the diagram of FIG. 1.

The removal of the masking sound as captured by each individual one of the left microphone 102 and the right microphone 104 can be implemented through use of adaptive filtering, as is explained with reference to the diagram of FIG. 2.

Figure 2:
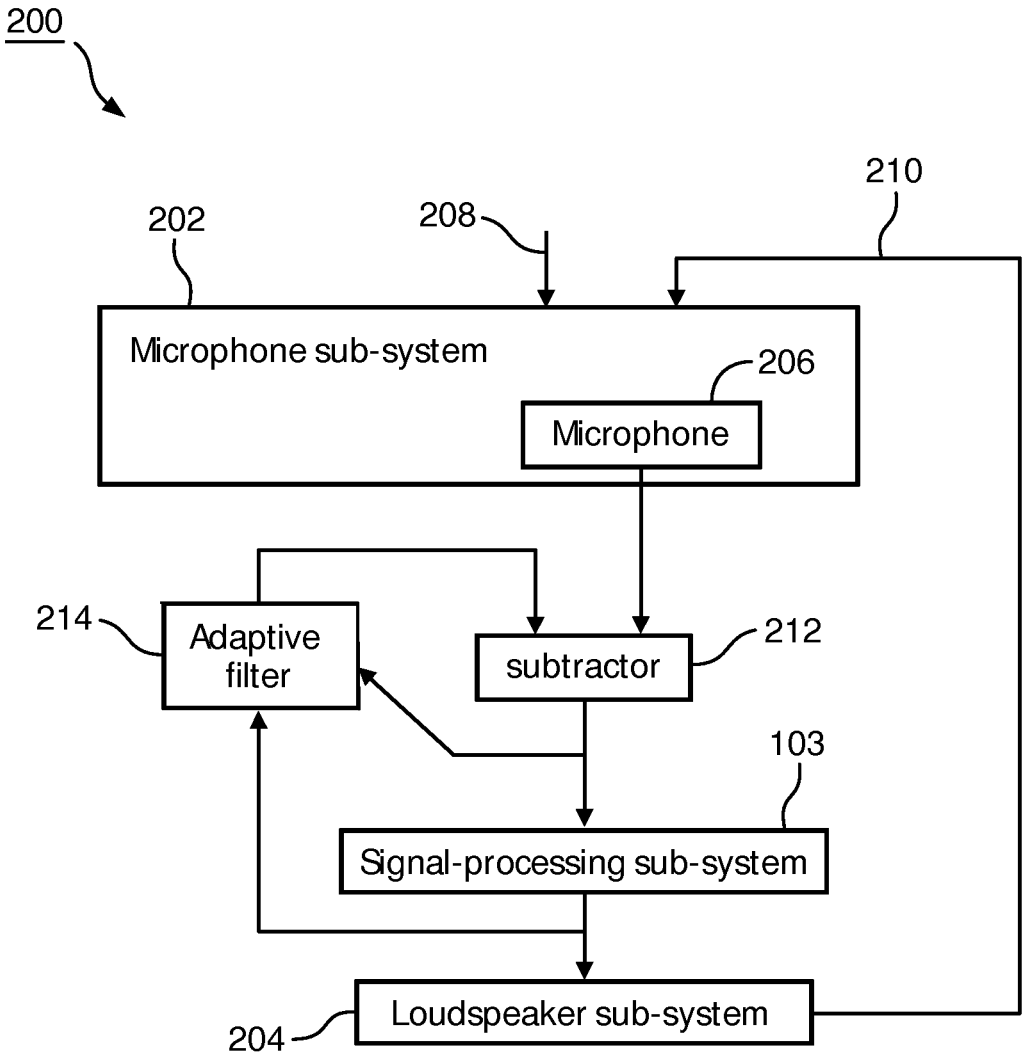
FIG. 2 is a block diagram of a second embodiment of a system in the invention.

FIG. 2 is a diagram of a second embodiment 200 of a system in the invention. The second embodiment 200 comprises a microphone sub-system 202, a loudspeaker sub-system 204 and the signal-processing sub-system 103 as discussed above. The microphone sub-system 202 may comprise one, two or more microphones, of which only a specific one is indicated with reference numeral 206. The loudspeaker system 204 may comprise one, two or more loudspeakers.

Each individual one of the microphones of the microphone sub-system 202, e.g., the specific microphone 206, may capture the sound to be masked as well as the masking sound, as reproduced by the loudspeaker sub-system 204 in the manner described above with reference to the first embodiment 100. The sound to be masked is indicated in the diagram of FIG. 2 with a reference numeral 208. The masking sound is indicated in the diagram of FIG. 2 with a reference numeral 210. The adaptive filtering is applied per individual one of the microphones of the microphone sub-system 202 and will be explained with reference to the specific microphone 206.

The specific microphone 206 captures the sound to be masked 208 as well as the masking sound 210 and supplies a first signal. The first signal is supplied to the signal-processing sub-system 103 via a subtractor 212. The subtractor 212 also receives a filter output signal from an adaptive filter 214 and is operative to subtract the filter output signal from the microphone signal. The output signal of the subtractor 212 is supplied to the signal-processing sub-system 103 described with reference to the first embodiment 100. The output signal of the signal-processing sub-system 103 as supplied to the loudspeaker sub-system 204 is supplied to an input of the adaptive filter 214. The adaptive filter 214 is configured for adjusting its filter coefficients under control of the output signal of the subtractor 212. Adaptive filtering techniques are well-known in the art and need not be discussed here in further detail.

The wearing of headphones (or of earphones) may be inconvenient. Instead, the loudspeakers and microphones of a system of the invention are positioned at a distance from the head of the user. In this case, an array of two or more microphones can used to obtain the directions of the disturbing sounds to be masked with respect to a preferably fixed position of the user's head using a beamforming technique. For example, in a hospital environment, the possible positions of the head of a patient lying in a hospital bed, erected at a fixed location in a hospital room, is usually limited to a small volume of space.

A one-dimensional array of microphones can then be used to sweep (in software) a narrow (microphone-) beam pattern along an axis that has a particular orientation with respect to the patient, e.g., the horizontal axis. A two-dimensional array of microphones can then be used to sweep (in software) a narrow (microphone-) beam pattern along two axes that have different particular orientations with respect to the patient, e.g., the horizontal axis and the vertical axis.

Note that, when using only a left microphone and the right microphone as located at or near the user's ears, an implementation of the spatial analyzer 134 may be used for determining the ITD and ILD. If the microphones are positioned remote form the user's head and if beamforming is being used to determine the directions of the sounds to be masked, another implementation of the spatial analyzer 134 may be used that is adapted to the specific beamforming technique.

When the loudspeakers are positioned away from the user's head, an implementation of the virtualizer 136 may be used so that, given the estimated incident directions of the target sounds, the masking sounds may be rendered at the same directions using the loudspeaker sub-system. This can be achieved by filtering the binaural signals with a matrix of filters to synthesize input signals for the loudspeaker array, where the filters are created so that the transmission paths to the user's ear positions may be relatively transparent (e.g., using cross-talk cancellation). Alternatively, beamforming can be used wherein two narrow beams are formed by a filter matrix, each respective one of which being directed to the respective one of the position of the user's left ear and the position of the user's right ear. Cross-talk cancellation is known in the art. The objective of a cross-talk canceller is to reproduce a desired signal at a single target position while cancelling out the sound perfectly at all remaining target positions. The basic principle of cross-talk cancellation using only two loudspeakers and two target positions has been known for a long time. In 1966, Atal and Schroeder used physical reasoning to determine how a cross-talk canceller comprising only two loudspeakers placed symmetrically in front of a single listener could work. In order to reproduce a short pulse at the left ear only, the left loudspeaker first emits a positive pulse. This pulse must be cancelled at the right ear by a slightly weaker negative pulse emitted by the right loudspeaker. This negative pulse must then be cancelled at the left ear by another even weaker positive pulse emitted by the left loudspeaker, and so on. The Atal and Schroeder's model assumes free-field conditions; the influence of the listener's torso, head and outer ears on the incoming sound waves are ignored (copied from a web page "Cross-Talk Cancellation" of the Fluid Dynamics and Acoustics Group, section "Virtual Acoustics and Audio Engineering" of the Institute of Sound and Vibration Research at the University of Southampton; URL=http://resource.isvr.soton.ac.uk/FDAG/VAP/html/xtalk.html).

The location(s), where the masking sound is intended to effectively mask the sound to be masked, can be fixed regardless of the direction(s) from the sound(s) to be masked is/are arriving at the user's head. In hospital rooms, the sources of sounds to be masked, e.g., electronic monitoring systems, are mostly located to the side of, or behind, the patient's bed. In this case, masking sounds can be created that have fixed directionality and only to the lateral positions and to the back, reducing the variability of the soundscape, and also reducing the required computational power needed for the adaptive filtering (as some of the adaptive filters can use fixed filter coefficients).

Figure 3:
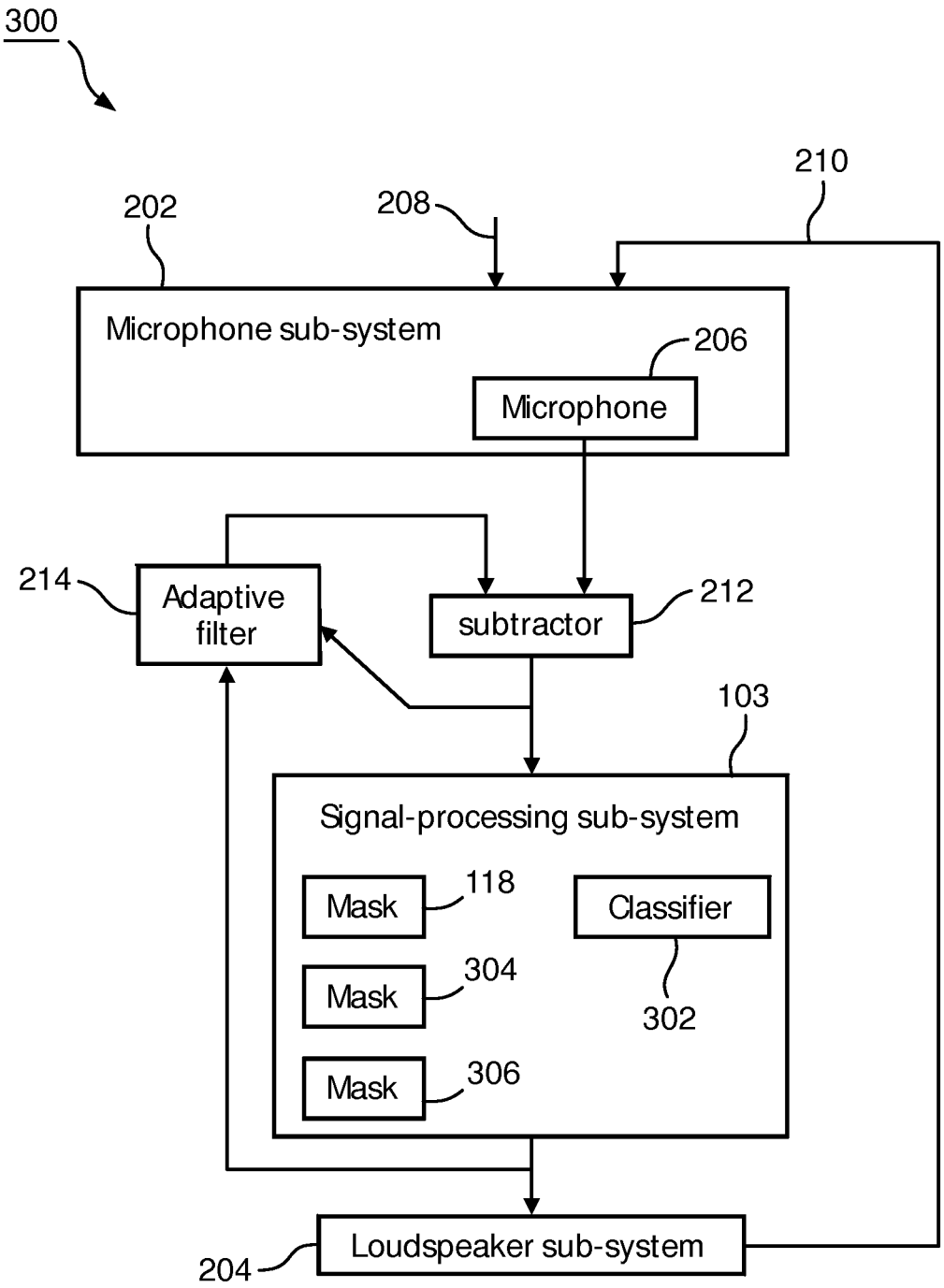
FIG. 3 is a block diagram of a third embodiment of a system in the invention.

FIG. 3 is a third embodiment 300 of a system in the invention. The third embodiment 300 comprises a sound classifier 302. The sound classifier 302 determines which portion of the sound as captured by the microphone sub-system 202 is going to be excluded from being masked. That is, the sound classifier 302 is configured to discriminate between sounds, captured by the microphone sub-system 202 and which are to be masked, and other sounds, which are captured by the microphone sub-system 202 and which are not to be masked (e.g., a human voice or an alarm), so as to selectively subject captured sounds to the process of being masked. For example, patients in hospital may want to have the sounds masked that are generated by close-by monitoring equipment, but may not want to have the doctor's or nurse's voice masked. The sound classifier 302 then blocks this portion of the captured sound from contributing to the generation of the masking sound. The sound classifier 302 may be implemented by selectively adjusting or programming in advance the band-pass filters, e.g., the left set of band-pass filters 114 and the right set of band-pass filters 116, whose output signals are supplied to the spectrum analyzer and spatial analyzer in each of the first sub-system 124, the second sub-system 126, the third sub-system 128, etc., so as to exclude certain frequency ranges in the captured sound from contributing to the eventual masking sound. As an alternative, the sound classifier 302 may be implemented by selectively inactivating the signal-processing sub-system 103 in the presence of a pre-determined type of contribution to the capture sound, the contribution being indicative of a sound that is not to be masked. The inactivating may be implemented under control of an additional spectrum-analyzer (not shown) that inactivates the signal-processing system 103 upon detecting a particular pattern in the frequency spectrum of the captured sound, or that inactivates the supply of the microphone signal to the subtractor 212 or to the signal processing sub-system 103 upon detecting a particular pattern in the frequency spectrum of the captured sound.

The first embodiment 100 is shown to accommodate the masking sound generator 118. The third embodiment 300 comprises one or more additional masking sound generators, e.g., a first additional masking sound generator 306 and a second additional masking sound generator 308, etc. Accordingly, instead of using a single type of masking sound for the processing at the signal-processing sub-system 103, a multitude of different masking sounds is used, a particular one of the masking sounds being tuned to a particular one of the sources that together produce the sound to be masked.

The invention claimed is:

1. A system configured for masking sound signal, comprising:

microphones for capturing the sound signals at multiple locations;

loudspeakers for generating at least one masking sound signal;

a computer configured by computer program instructions to:

determine a power attribute of a frequency spectrum of at least one sound signal of the sound signals, wherein the power attribute of the frequency spectrum is representative of a power in a frequency band of the at least one sound signal;

determine a directional attribute of the at least one sound signal in the frequency band, wherein the directional attribute of the at least one sound signal is representative of a direction from which the at least one sound signal is captured; and control at least one loudspeaker of the loudspeakers to generate the at least one masking sound signal based on the power attribute and the directional attribute of the at least one sound signal such that a direction of the generated at least one masking sound signal is based on the directional attribute.

2. The system of claim 1, wherein:

the microphones supply a first signal representative of the at least one sound signal;

the computer supplies a second signal for control of the loudspeakers;

the system comprises:

an adaptive filter for receiving the second signal and supplying a filtered version of the second signal; and a subtractor for receiving the first signal, receiving the filtered version of the second signal, and supplying a third signal to the computer that is representative of a difference between the first signal and the filtered version of the second signal; and the adaptive filter has a control input for receiving the third signal for control of one or more filter coefficients of the adaptive filter.

3. The system of claim 1, comprising a sound classifier that is operative to selectively remove a pre-determined portion from the at least one sound signal before carrying out the determining of the power attribute and before carrying out the determining of the directional attribute.

4. The system of claim 1, wherein the controlling comprises:

selecting the at least one loudspeaker from among the loudspeakers based on the at least one loudspeaker corresponding to at least one microphone of the microphones that captured the at least one sound signal; and controlling the at least one loudspeaker to generate the at least one masking sound signal based on the power attribute and the directional attribute of the at least one sound signal such that the direction of the at least one masking sound signal is the same as the direction from which the at least one sound signal is captured by the at least one microphone.

5. A method for masking sound signals, comprising:

capturing the sound signals at multiple locations;

determining a power attribute of a frequency spectrum of at least one sound signal of the sound signals, wherein the power attribute of the frequency spectrum is representative of a power in a frequency band of the at least one sound signal;

determining a directional attribute of the at least one sound signal in the frequency band, wherein the directional attribute of the at least one sound signal is representative of a direction from which the at least one sound signal is captured; and generating the at least one masking sound signal based on the power attribute and the directional attribute of the at least one sound signal such that a direction of the generated at least one masking sound signal is based on the directional attribute.

6. The method of claim 5, further comprising:

receiving a first signal representative of the at least one sound signal;

supplying a second signal for generating the at least one masking sound signal; and adaptive filtering for reducing a contribution from the at least one masking sound signal, present in the at least one sound signal, to the second signal, wherein the adaptive filtering comprises:

receiving the second signal;

using an adaptive filter for supplying a filtered version of the second signal;

supplying a third signal that is representative of a difference between the first signal and the filtered version of the second signal;

receiving the third signal for control of one or more filter coefficients of the adaptive filter; and using the third signal for the determining of the power attribute and for the determining of the directional attribute.

7. The method of claim 5, further comprising selectively removing a pre-determined portion from the at least one sound signal before carrying out the determining of the power attribute and before carrying out the determining of the directional attribute.

8. A non-transitory computer-readable medium having instructions recorded thereon, wherein the instructions, when executed by a computer, cause the computer to perform following:

capturing sound signals at multiple locations;

determining a power attribute of a frequency spectrum of at least one sound signal of the sound signals, wherein the power attribute of the frequency spectrum is representative of a power in a frequency band of the at least one sound signal;

determining a directional attribute of the at least one sound signal in the frequency band, wherein the directional attribute of the at least one sound signal is representative of a direction from which the at least one sound signal is captured; and generating the at least one masking sound signal based on the power attribute and the directional attribute of the at least one sound signal such that a direction of the generated at least one masking sound signal is based on the directional attribute.

9. The non-transitory computer-readable medium of claim 8, wherein the instructions, when executed by the computer, further cause the computer to perform following:

receiving a first signal representative of the at least one sound signal, supplying a second signal for generating the at least one masking sound signal; and adaptive filtering for reducing a contribution from the at least one masking sound signal, present in the at least one sound signal, to the second signal, wherein the adaptive filtering comprises:

receiving the second signal;

using an adaptive filter for supplying a filtered version of the second signal;

supplying a third signal that is representative of a difference between the first signal and the filtered version of the second signal;

receiving the third signal for control of one or more filter coefficients of the adaptive filter; and using the third signal for the determining of the power attribute and for the determining of the directional attribute.

10. The non-transitory, computer-readable medium of claim 8, wherein the instructions, when executed by the computer, further cause the computer to selectively remove a pre-determined portion from the at least one sound signal before carrying out the determining of the power attribute and before carrying out the determining of the directional attribute.

* * * * *